United States Patent [19]

Kettler et al.

[11] 4,225,249

[45] Sep. 30, 1980

[54] VARIABLE CHARACTER SPACING MATRIX FOR PROPORTIONAL SPACING PRINTING SYSTEMS

[75] Inventors: Howard G. Kettler; Robert A. Kolpek, both of Lexington, Ky.; Walter S. Rosenbaum, Bethesda, Md.

[73] Assignee: International Business Machines Corporation, Armonk, N.Y.

[21] Appl. No.: 810,329

[22] Filed: Jun. 27, 1977

[51] Int. Cl.[2] ..... B41J 19/58

[52] U.S. Cl. ..... 400/3; 400/9; 400/64; 400/76; 400/111; 400/279; 400/304; 400/306; 400/320; 400/328

[58] Field of Search ..... 197/1 A, 19, 84 R, 84 A, 197/84 B

[56] References Cited

U.S. PATENT DOCUMENTS

| | | | |
|---|---|---|---|
| 2,742,998 | 4/1956 | Szczepanowski | 197/84 B X |
| 3,267,454 | 8/1966 | Schaaf | 197/84 B X |
| 3,354,816 | 11/1967 | Giannuzzi | 197/84 R X |
| 3,513,968 | 5/1970 | Hanson | 197/84 R X |
| 3,631,957 | 1/1972 | Terry | 197/19 |
| 3,712,443 | 1/1973 | Mathews | 197/84 A |
| 3,757,921 | 9/1973 | Bishop | 197/19 |
| 3,850,279 | 11/1974 | Kolpek | 197/19 |
| 3,998,311 | 12/1976 | Greek et al. | 197/84 A X |

*Primary Examiner*—Ernest T. Wright, Jr.
*Attorney, Agent, or Firm*—John W. Henderson, Jr.

[57] ABSTRACT

The aesthetic characteristics of adjacent characters are used to enhance the quality of output in a proportional spacing printer and to provide right margin justification for composing. Spacing between characters is determined on the basis of the character being printed and the preceding character already printed on the page. An intercharacter displacement memory contains a list of ideal spacing for all combinations of characters to be printed. As each character is typed, it and the previously stored preceding character address the intercharacter displacement memory. The output of the intercharacter displacement memory is the ideal value of escapement for this combination of characters and font style. The printer positions the print head prior to printing the next character, rather than positioning the print head after the previous character is printed. Line ending decisions for composing are eliminated during initial and final typing of a document by adding to the intercharacter displacement memory recommendations for altering the ideal spacing between characters, where aesthetically possible, to eliminate the need for line ending hyphenation. During initial keying, escapements for adjacent pairs of characters are totaled in a memory for ideal, shortest (tight), and longest (loose) recommended escapements. The line is automatically terminated within the justification range by a carrier return function based on the escapement totals and the selected right margin. Final playout of the page from memory alters the intercharacter escapements from the ideal values to either longer or shorter escapements depending on whether the line is to be lengthened or shortened.

10 Claims, 7 Drawing Figures

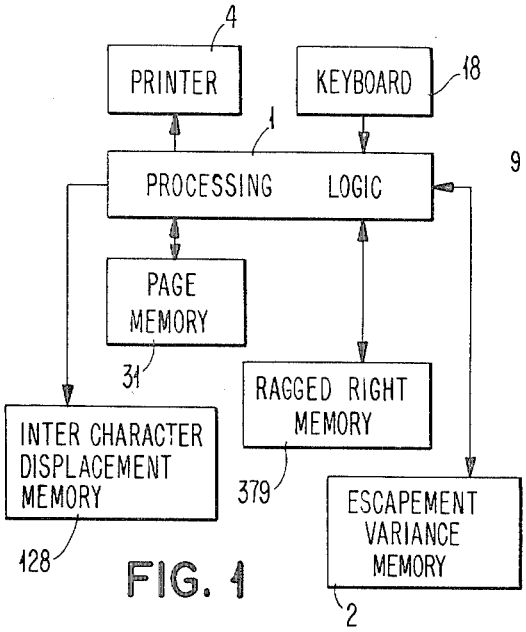
FIG. 1
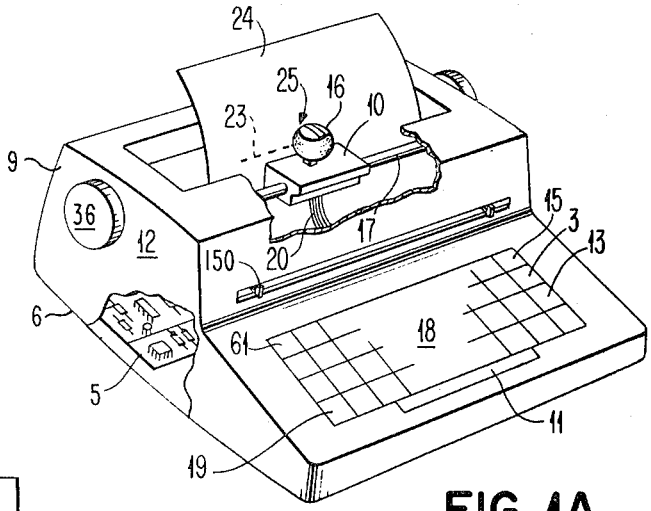
FIG. 1A
FIG. 2
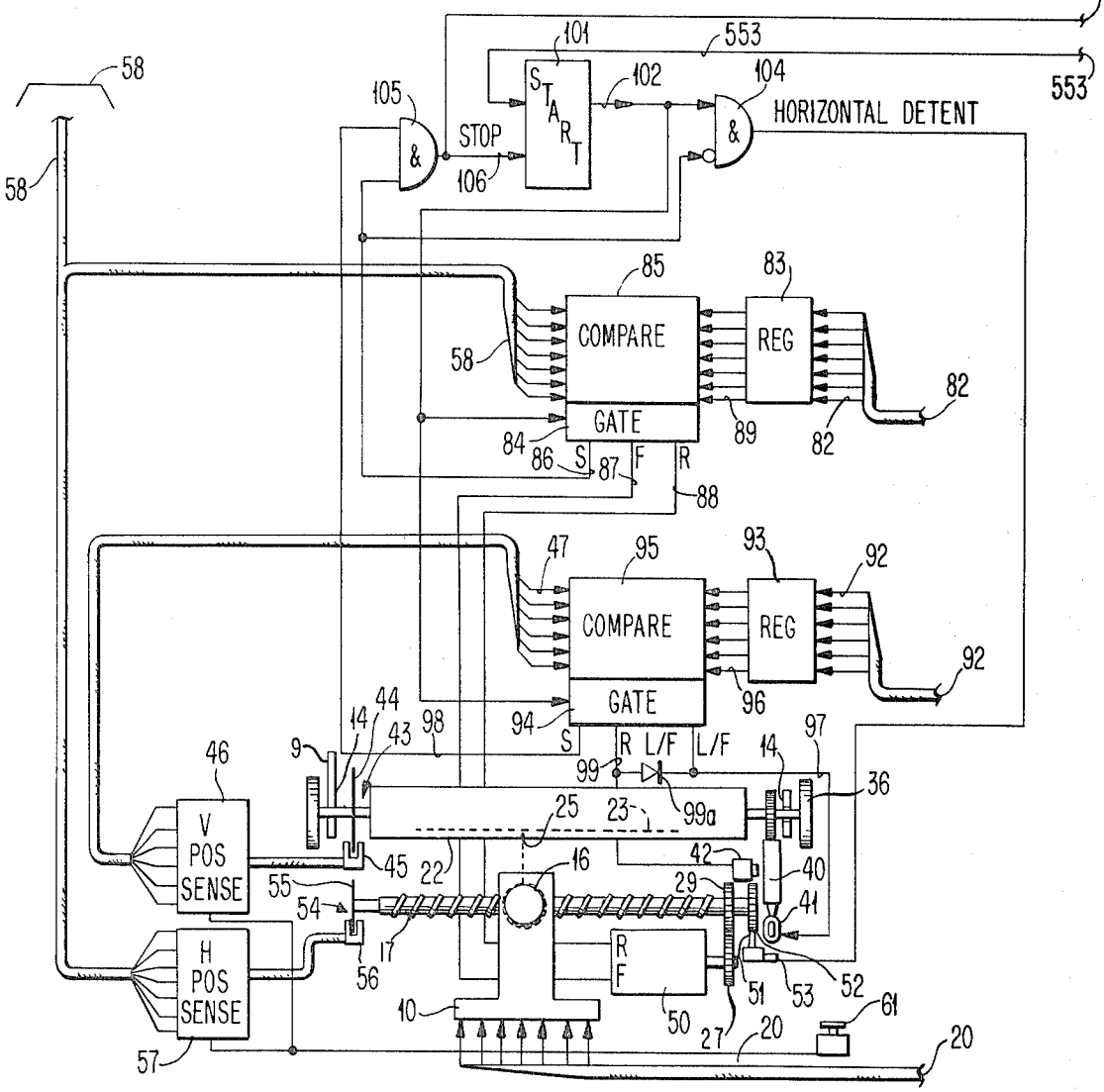

TO FIG. 2

VARIABLE CHARACTER SPACING MATRIX FOR PROPORTIONAL SPACING PRINTING SYSTEMS

BACKGROUND OF THE INVENTION

1. Field of the Invention

The invention disclosed herein relates to printing devices, and more particularly to devices for the production of proportionally spaced, high quality justified copy without the use of hyhenation.

2. Description of the Prior Art

Traditionally, proportionally spaced typing has had a fixed format. A given printed character always occupies the same number of horizontal space units although this may vary from character to character (M to I) when typed on a proportionally spaced machine. The characters are somewhat distorted on conventional printers to occupy the entire space allocated to the character. Particularly difficult is the English Script character set and the Arabian Farsi character set, where, to some extent, the characters appear joined together. The problems occur because of the number of combinations of character pairs found in ordinary text. When the spacing between one combination is enhanced, other combinations become poor.

In U.S. Pat. No. 2,742,998 an attempt was made at solving the problem by changing the shapes of so called "lean" letters and placing these "lean" letters in digraphs and trigraphs on the same key face such that the digraph or trigraph would take no more horizontal space than one "fat" small letter, for example "w". This technique, while increasing the number of letters that could be typed on a line, did little to upgrade the aesthetic quality of the type and, in fact, degraded the aesthetic quality because the characters were distorted in order to decrease the space between them. Also, no provision was made for comparably reducing the space between individual characters and the digraphs or trigraphs which formed a part of the same word nor between adjacent digraphs or trigraphs.

A more burdensome problem exists where the printer is to be used for right margin justification of text. It has been common practice, when a word would not fit entirely within a printing line to divide the word on syllable boundaries with a hyphen so that one segment of the word can be accommodated at the end of the line and the other segment accommodated at the head of the following line. This method is used in publication activities to avoid ragged right-edge composition and achieve a high utilization of paper.

Present printing systems provide for the addition of space between words to increase the length of the line to bring its length to the chosen right margin. Exemplary of these kinds of printers are U.S. Pat. Nos. 2,465,657 and 3,530,976. In the U.S. Pat. No. 2,465,657, the text to be justified is printed in a first column as it is keyed by the user. The text must then be rekeyed in a second column while the printer automatically adjusts the interword spacing to justify the right margin. In the U.S. Pat. No. 3,530,976 interword spacing is held to a predetermined minimum space during intial keying. A delta space is then added to each interword space during final playout to obtain right margin justification. However, if the number of interword spaces is too small to fill out the line, hyphenation must be done by the user. This generally results in the use of a dictionary to provide information on syllabication of the word and a corresponding loss of valuable time. Additionally, increases in the interword spacing in a line of printed text causes a corresponding deterioration in the aesthetic quality of the print.

SUMMARY OF THE INVENTION

The aesthetic quality of printed text in a proportionally spaced printer may be enhanced without the corresponding distortion of the characters by providing for variable escapement for the printing of characters based on the contour of the character previously printed as well as the contour of the character to be printed. An intercharacter displacement memory is provided which contains the ideal relative displacement values for combinations of two characters. As a character is keyed it goes into a storage register and provides half the information for addressing the intercharacter displacement memory. After the character is printed, the print mechanism does not escape. When the next character is keyed, it provides the information necessary to complete the addressing of the intercharacter displacement memory. The output of the intercharacter displacement memory provides the escapement value necessary for the ideal aesthetic appearance between the two characters. The print mechanism is escaped by this amount and the character is printed.

For composing applications, the intercharacter displacement memory includes, in addition to the ideal escapement values between pairs of characters, variable escapements for certain character pairs which may be moved closer together or farther apart with a minimum of aesthetic distortion. The first character keyed is placed in a page storage memory and is printed on the page without any escapement following printing. When the second character is keyed, its value and the value of the previous character are utilized to determine an escapement which occurs before the second character is printed. As the line is typed, these escapements values are totaled in an ideal total register and modified, either by adding an increment for a loose total or by subtracting an increment for a tight total as specified by the intercharacter displacement memory, to also provide deviation totals for each line. These totals are compared by an analysis circuit after each word is typed to determine whether the line may be justified. When it is determined that the line can be justified, the circuitry terminates the line automatically with a carrier return code and the user continues typing a sentence.

The first copy produced while keying is considered a draft copy. To obtain a justified copy the operator places a new sheet of paper in the printer and the circuitry analyzes the first line from page memory to determine whether the line may be printed ideally, tightly, or loosely. As this is done, the difference register is filled to keep track of the number of increments to be added or subtracted as the line is printed.

The printer then prints the first character and, along with the next character, determines the intercharacter escapement. This value is modified depending on whether the line is to be expanded or contracted and whether the individual character couple has appropriate characteristics, according to the intercharacter displacement memory. The result will be the printing of the line, utilizing modified escapement values which will still maintain superior print quality when compared to any other justifying system. In addition, if absolute justification is not desired, deviation of the right margin may be minimized by means of ragged right memory which can reduce the deviation to less than six characters.

BRIEF DESCRIPTION OF THE DRAWING

FIG. 1 is a block diagram of a printing system, including the apparatus of the present invention.

FIG. 1*a* is a perspective view of a typewriter, including a keyboard and printer and showing the electronics contained therein.

FIG. 2 is a diagramative illustration of the typewriter shown in FIG. 1*a*, together with the control circuitry by which the printer mechanism is controlled.

DETAILED DESCRIPTION

Figure 2A:
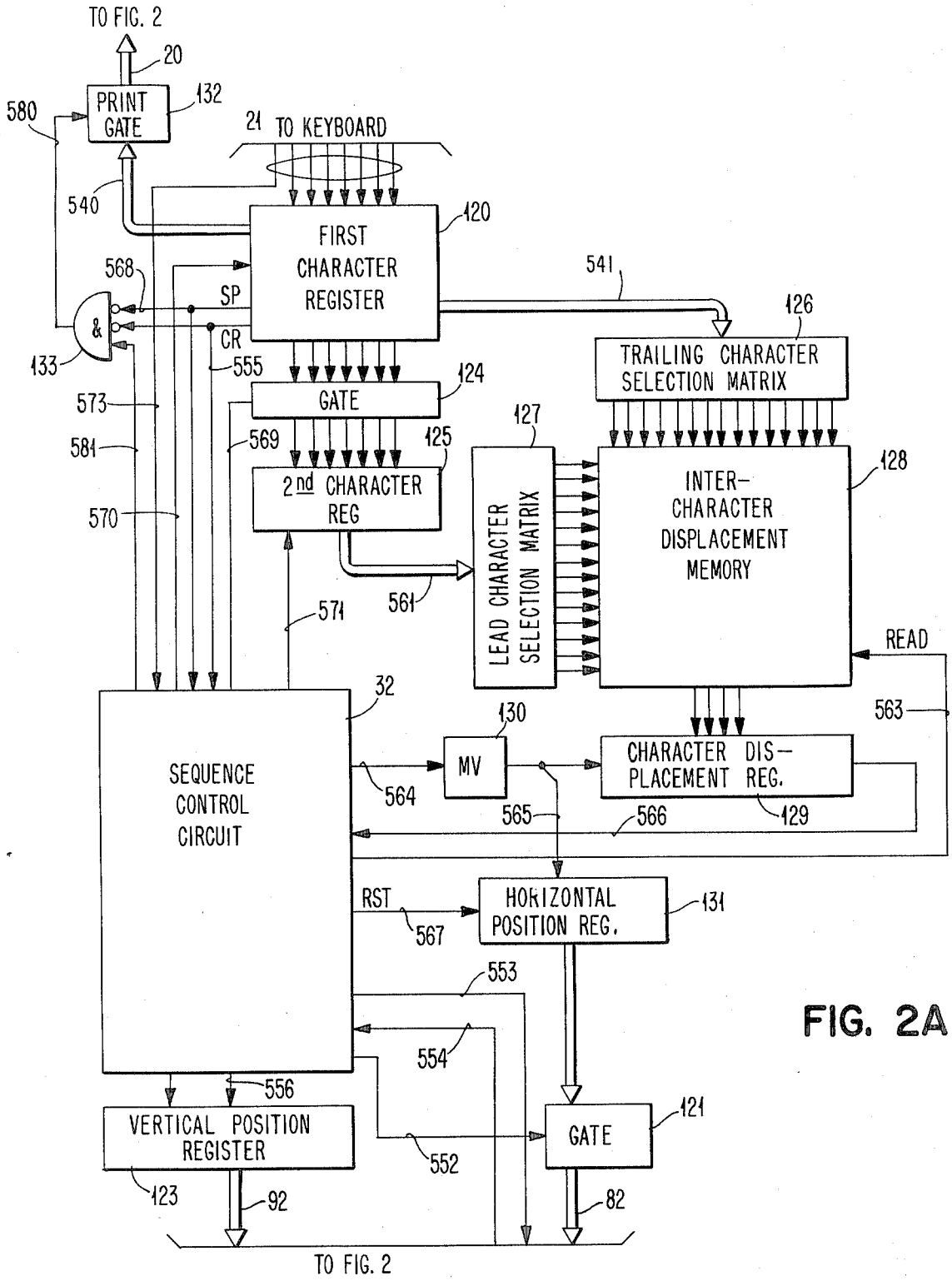
FIG. 2*a* is a diagramatic illustration of the circuitry for proportionally spaced printing.

Referring now to FIG. 1, there is shown in block diagram form a printing system. The system includes processing logic 1, escapement variance memory 2, intercharacter displacement memory 128, printer 4, keyboard 18, page memory 31, and ragged right memory 379. The printer 4 may be a serial character—by—character page printer or a typewriter 12 (FIG. 1*a*) that is generally like the well known IBM "Selectric" ® I/O Writer as described in IBM Customer Engineering "Selectric" ® I/O Writer Instruction Manual, form/part number 241-5159-1, revised Nov. 12, 1962, published by International Business Machines Corporation, Armonk, N.Y. The typewriter 12 includes the well known printing mechanism 10 comprising a type element 16 having character shaped type thereon. The type element 16 together with a page supporting impact resistent platen 22 defines a print point 25. The platen 22 is rotatably supported by bearings 14 in the typewriter frame 9. The typewriter 12 also includes a left margin stop 150 and a keyboard 18 having printing control keys and print position moving keys such as a space bar 11, line return key 13, right margin key 15, auto/playout key 19, reset key 61 and ragged right key 3. Circuit boards 5 containing the electronics for the system are mounted in the base 6 of the typewriter 12.

Referring now to FIG. 2, the typewriter 12 is provided with horizontal and vertical motion transducers 54 and 43 respectively, each of which can be similar in theory and operation to that disclosed in U.S. Pat. No. 3,579,195. The horizontal motion transducer 54 comprises a pulse emitting wheel 55 which generates strobed position and direction information in photosensing mechanism 56 by which displacement of the lead screw 17 in increments is measured. Suitable control circuitry, including a counting register provides a digital horizontal print point position sensing device 57. The sensing device 57 stores a true binary code output that numerically represents the column position of print point 25 along the writing line 23.

The vertical motion transducer 43 is substantially identical to transducer 54 and includes an emitter wheel 44, and an optical sense mechanism 45. Suitable control circuitry including a counting register provides a digital vertical print position sensing device 46. Sensing device 46 stores a binary code output which is numerically representative of the writing line position of the page 24 within the typewriter 12.

The lead screw 17 is driven through gears 27 and 29 by a direct current, forward and reverse drive motor 50. The printing mechanism 10 thus is positioned along the length of platen 22 by operation of the motor 50. To obtain precise positioning of the print point 25, a detent member 51 is normally engaged with a ratchet wheel 52 on the lead screw 17. When seeking a new typing field, electromagnet 53 is activated to withdraw the detent member 51 from ratchet wheel 52 and thereby free the lead screw 17 for movement prior to driving of lead screw 17 by motor 50. Termination of lead screw rotation is followed by release of electromagnet 53 and reentry of the detent member 51 to again precisely position and hold the lead screw 17.

In summary, it is seen that the typewriter 12 provides a mechanism capable of positioning the print point 25 horizontally and vertically both in the forward and reverse directions. A more detailed description of the typewriter 12 may be found in U.S. Pat. No. 3,850,279. While a type impact printer has been illustrated, those of skill in the art will recognize that a serial printer operating to produce visibly hard copy by other techniques would be equally appropriate. For example, the printing mechanism 10 could employ a controlled ink jet spray, a thermal matrix, or an optical character generator with equal facility.

In operation, page 24 is inserted by the operator to align a fixed position on the page 24 with the print point 25. The page 24 is manually aligned by the operator by rotating the platen 22 using knob 36. Reset key 61 is depressed to set the horizontal position sensing device 57 and vertical position sensing device 46 to a zero or normalized position following insertion of the page 24. Thereafter, all displacement of the print point 25 relative to the page 24 is accounted for in the horizontal and vertical print point position sensing devices 57 and 46 as unit displacement is added or subtracted with the motion of either the platen 22 or printing mechanism 10.

Referring now to FIG. 2*a*, keyboard 18 is connected to first character register 120 by leads 21. Characters keyed on the keyboard 18 are stored in the first character register 120 and are gated under control of the sequence control circuit 32 by print gate 132 from bus 540 over bus 20 to print mechanism 10 located in FIG. 2. Control circuits for providing sequential operating signals to asynchronous operating systems are well known in the prior art and will not be discussed herein in detail. For example, a read only memory may be used where each of the signals input to the read only memory accesses a specified address within the read only memory which outputs one signal or a series of signals in response to the input. Basic sequence control circuits exist in text books. As an example, the textbook entitled "Arithmetic Operations in Digital Computers" by R. K. Richards, copyright 1955, published by D. Van Nostrand Company, Inc, at pages 337–342 features two exemplary sequence control circuits. The first of these circuits is a clocked or "synchronous" control circuit and the second one is an unclocked or "asynchronous" control circuit.

Richards asynchronous control circuit comprises an operation matrix having an output line for each of the operations the system will perform and having miscellaneous input lines from other devices in the system. The operation matrix and the miscellaneous input lines from other devices communicate with a series of AND gates and delays. Inputs to the AND gates pass through the delays to provide output command signals which are used to run the system in the sequential manner described in this application. In an asynchronous control system, as in the sequence control circuit of this invention, "there is no fixed time reference for the execution of the operations. Instead, one operation is commenced as soon as the previous one is completed. To accomplish this purpose, the circuits must be arranged so that, at the completion of each operation, a signal is generated which may be used to initiate the next one." Logic circuits of the type described by Richards have been standardized in the electronics industry. For example, an industry standard AND gate is the 7411 and an industry standard delay circuit is the 74123 dual retriggerable monostable multi-vibrator as described in the "TTL Data Book For Design Engineers," by Texas Instruments, Incorporated, Copyright 1976. Information in the first character register 120 is subsequently gated into the second character register 125 under control of the sequence control circuit 32 prior to the next character being keyed on the keyboard 18. The contents of the second character register 125 are decoded by lead character selection matrix 127 over line 561 to provide half the addressing information for the intercharacter displacement memory 128. The next character then enters the first character register 120 and is decoded by the trailing character selection matrix 126 over bus 541 to provide the second half of the address information to the intercharacter displacement memory 128.

The intercharacter displacement memory 128 contains at each address therein, a representation of the ideal spacing value for the two characters which make up the address. This spacing value is predetermined based upon the contours of the characters and permanently stored in the intercharacter displacement memory 128. The displacement value, when read from the intercharacter displacement memory 128, is temporarily stored in character displacement register 129 and counted down to zero by multivibrator 130 which simultaneously supplies pulses to increment the horizontal position register 131 to provide a running total of horizontal increments on the line being typed. In addition, the keyboard 18 signals the sequence control circuit 32 to increment the vertical position register 123 whenever the operator keys a carrier return or line feed code such that the vertical position register 123 always keeps track of the line on the page 24 onto which the typist is keying.

Values from the horizontal position register 131 and the vertical position register 123 are extended over cables 82 and 92 respectively, to the horizontal and vertical positioning circuitry in FIG. 2 which operates as previously described. The sequence control circuit 32 signals gate 121 on line 552 to gate the contents of the horizontal position register 131 on data bus 82 into binary register 83 of FIG. 2. Carrier return codes from the keyboard 18 pass from the first character register 120 over line 555 through the sequence control circuit 32 and into the vertical position register 123 over line 556 where they are accumulated. The contents of the vertical position register 123 are passed over cable 92 into register 93. As is well known in the art, the registers 83 and 93 are constructed to be overridden by whatever information is gated into them. The contents of registers 83 and 93 are compared over lines 89 and 96 by comparators 85 and 95 to the contents of horizontal position sense register 57 on line 58 and vertical position sense register 46 on line 47 which contain the present print position of the printing mechanism 10 on the page 24. An unequal comparison indicates that the printing mechanism 10 is not at the requested location on the page 24. A start carrier and page positioning signal is initiated by the sequence control circuit 32 on line 553 to latch 101 to cause the printing mechanism 10 to escape the ideal amount of space for the two character pair determined from the intercharacter displacement memory 128. The output of the start latch 101 passes over line 102 to AND gate 104 and to gates 84 and 94 to gate out the results of the position comparison in comparators 85 and 95. Until the print mechanism 10 escapes by the correct amount of space, the signal on line 86 is low and is inverted at the input of AND gate 104 to pass the start signal and release the horizontal detent latch 53. The print point 25 is then moved in the forward or reverse horizontal direction by a signal on line 87 or line 88 to motor 50. If the output of the vertical compare 95 is "not S" on line 98, then a signal will be produced on line 97 to drive the line feed mechanism 40 through activating magnet 41 to rotate the platen 22 to move the print point 25 toward the bottom of the page 24 or, a signal will be produced on line 99 to reversing magnet 42 and passed through diode **99*a* to activate the line feed mechanism 40 over line 97 and rotate the platen 22 to move the print point 25 toward the top of the page 24. When the print mechanism 10 has been positioned at the desired print point 25, positive S signals from comparators 85 and 95 will pass through gates 84 and 94 and onto lines 86 and 98. The S signals on lines 86 and 98 are combined at AND gate 105 to produce a STOP signal on line 106 to reset the START latch 101. The S signal on line 86 also deactivates AND gate 104 to release the horizontal detent magnet 53 and lock the lead screw 17 against further rotation. The positive drive signals to the motor 50 and line feed mechanism 40 are removed when the S signals become positive since the comparators 85 and 95** will only produce a single positive output at a time.

Figure 3:
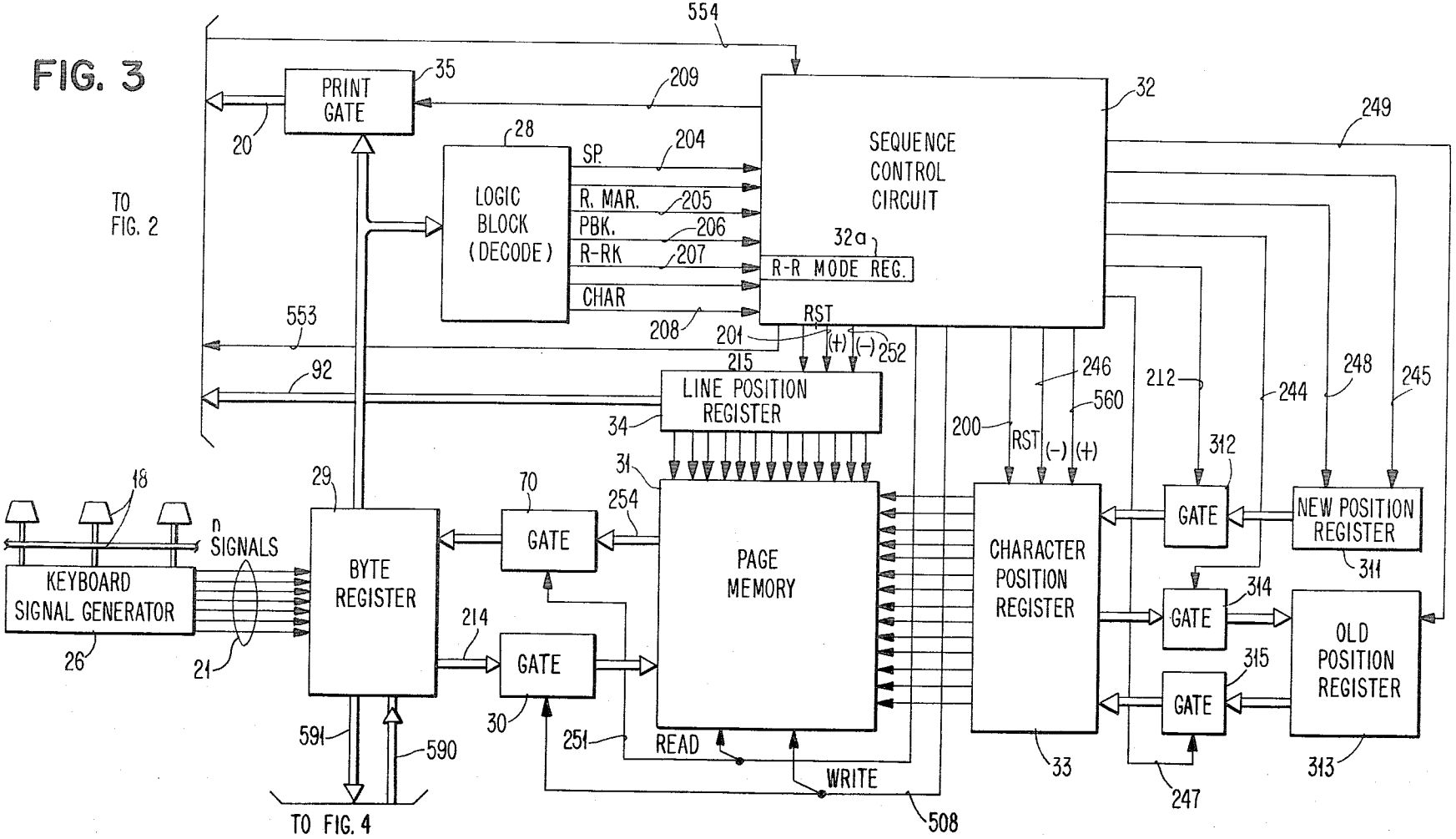
FIG. 3 is a circuit diagram for control of the page memory.

Referring now to FIG. 3, for the case where the text is also to be right margin justified, keyboard 18 operates signal generator 26 which is connected by data bus 21 to byte register 29. These signals are decoded by logic block 28 and stored in page memory 31 by means of sequence control circuit 32 and AND gate 30 through bus 214 at a point designated by the character position register and line position register designated 33 and 34 respectively. Byte register 29 also provides information through print gate 35 to printing mechanism 10 over bus 20.

Still referring to FIG. 3, old position register 313 has its input and output connected to character position register 33 through gates 314 and 315 respectively. If a line is overrun, i.e., the typist inadvertantly types more characters on the line than the line can hold, the old position register 313 contains a pointer which represents the position in page memory 31 of the last word in the line which will have to be removed and placed on the succeeding line. New position register 311 is connected to character position register 33 through gate 312. The new position register 311 contains a pointer which points to the place at the beginning of the next line to which the word is being transferred. Movement of the word is accomplished by the sequence control circuit 32 and gates 312, 314, 315, the character position register 33, and line position register 34.

Figure 4:
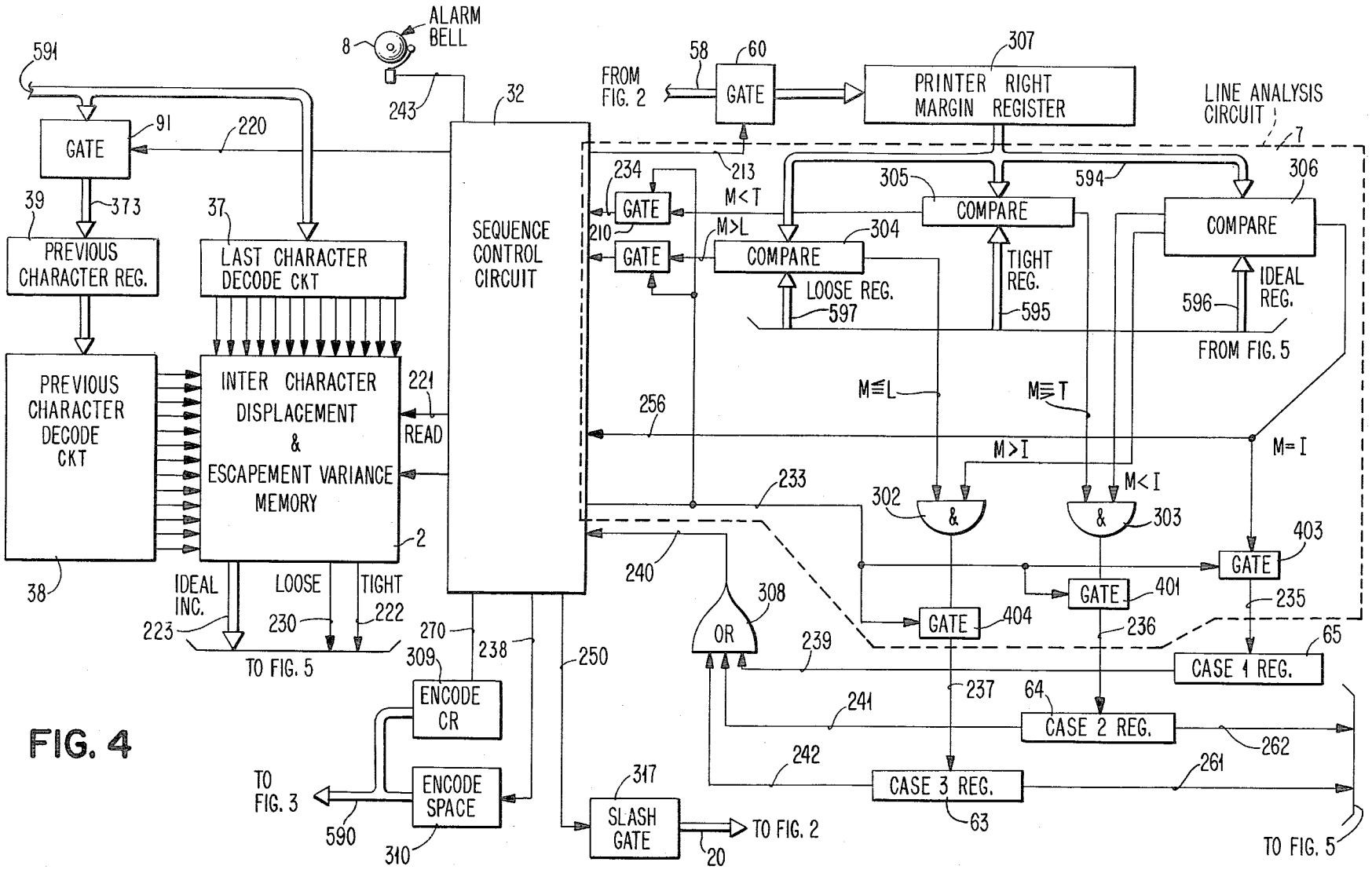
FIG. 4 is a diagramatic illustration of the circuitry for right margin justified printing.

Referring now to FIG. 4, there is shown the intercharacter displacement and escapement variance memory 2 which contains an ideal escapement increment value, a tight escapement bit (when applicable), and a loose escapement bit (when applicable) for each pair of adjacent characters which can be typed on a page. These values in the escapement variance memory 2 control the aesthetic quality of the printed final copy. Different character fonts would contain different values in the escapement variance memory 2. Some character combinations would have no tight bit indicating that these characters should never be placed closer than the ideal spacing value. An illustration of this would be two adjacent M characters (MM). Some character combinations would contain no loose bit because separating these characters any farther than their ideal value would reduce the aesthetic quality of the printing typing also. An illustration of this type of character pair would be the typing adjacent A characters (AA). An illustration of a character which can easily be tightly coupled with the next character would be the combination AW. Similarly, the MM pair could easily be loosely coupled, affording more space between the two adjacent vertical bars of M.

Tables 1 and 2 show examples of character combinations in which space units may be deleted from or added to the character pairs. These tables are not purported to be all inclusive and are based on a printer having 120 units per inch of horizontal space. The character combinations will vary according to the escapement capability of the printer being used.

TABLE 1

| DELETION LIST |
|---|
| Full Space Delete |
| AT AV AW AY FA LT LV |
| LW LY PA TA VA WA YA |
| All combinations ending with |
| .,:;' |
| Half Space Delete |
| AC AG AO AQ AU AV AW CQ DA DT DW DY FI FJ FL FT |
| FV FW FX FY IT IW IY KO KZ LC LO LU LQ OA |
| OT OV OW OX OY PF PL QA QT QV QW QX QY RC |
| RE RF RG RK RL RO RP RQ RT RV RW RY ST SW |
| SY TC TE TF TG TJ TK TL TO TP TQ TR VA VT |
| VC VE VF VG VK VL VO VP VQ WC WE WF WG WL |
| WO WP WQ WR XC XE XF XG XK XL XO XP XQ XR |
| YC YE YF YG YK YL YO YP YQ YR ZC ZE ZF ZG |
| ZK ZL ZO ZP ZQ ZR ZT |
| Ta Tc Te Ti Tj Tm Tn To Tp Tq Tr Ts Tu |
| Tv Tw Tx Ty Tz Va Vc Ve Vg Vi Vj Vm Vu Vo |
| Vp Vq Vr Vs Vu Vw Wa We Wi Wo Wr Ya Ye Yc |
| Yi Yo Yr (Any character preceding or following I) |
| fi fl ff (Any character preceding or following f i j l r s t) |

TABLE 2

| ADDITION LIST |
|---|
| Full Space Addition |
| Any combination of upper case letters except A, T, V and immediately following L. |
| Any combination of upper case and lower case except following A, L, T and V. |
| Any combination of lower case letters. |
| Half Space Addition |
| Any combination of upper case letters except A, T, V and immediately following L. |
| Any combination of upper and lower case except following A, L, T and V. |
| Any combination of lower case letters. |

The escapement variance memory 2 is accessed by the combination of the decode of the last character keyed on the keyboard 18 and the decode of the previous character keyed on the keyboard 18. Last character decode circuit 37 has its input connected to byte register 29 over bus 591 to receive from the keyboard 18 the last character keyed thereon. This character is decoded by last character decode circuit 37 and provides one-half of the address to the escapement variance memory 2. The previous character keyed on the keyboard 18 is gated by sequence control circuit 32 through gate 91 on bus 373 into previous character register 39. The content of previous character register 39 is decoded by a previous character decode circuit 38 and provides the second half of the address to the escapement variance memory 2. The output of the escapement variance memory 2 provides an ideal escapement on bus 223 for the two character pair and, if applicable, a loose character bit indication on bus 230 or a tight character bit indicator on bus 222.

FIG. 4 also contains a gate 60 which is activated over line 213 by sequence control 32 to store the typewriter right margin value in register 307 over bus 58 from the horizontal position sense register 57 and a line analysis circuit 7 enclosed by the dashed lines for comparing the right margin value with the total escapement values of tightly coupled, ideally coupled, and loosely coupled lines to determine whether the line being processed is case 1 (the ideally coupled line), case 2 (the tightly coupled line), or case 3 (the loosely coupled line). For simplicity, this implementation illustrates only one degree of tightness and looseness in coupling characters.

It is obvious, however, that at least one or two more degrees of looseness could result in two additional cases. In addition, a table of relative aesthetic goodness of adjustment values could be stored in the intercharacter displacement and escapement variance memory 2 to allow another judgemental factor to be entered into the justification computation to discern appropriately between alternative intercharacter displacement options within a word or within a line. If the machine described is to provide a justified final copy, the total escapement value for each line on the page 24 is the value found in the printer right margin register 307. If a line is determined to be a case 1 line, the escapement between each pair of characters in that line would be that of the ideal escapement value. Where the ideal escapement value total falls short of the right margin register value, a case 3 line results. For case 3, a certain number of characters which can be loosely coupled provide additional escapement increments to bring the total escapement of the line equal to the value of the right margin register 307. Where the total value of the ideal total register 67 exceeds that of the right margin register 307, a case 2 line results. In a case 2 line, some tightly coupled escapement values are used in order to reduce the total escapement value of the line to agree with the right margin register 307.

Figure 5:
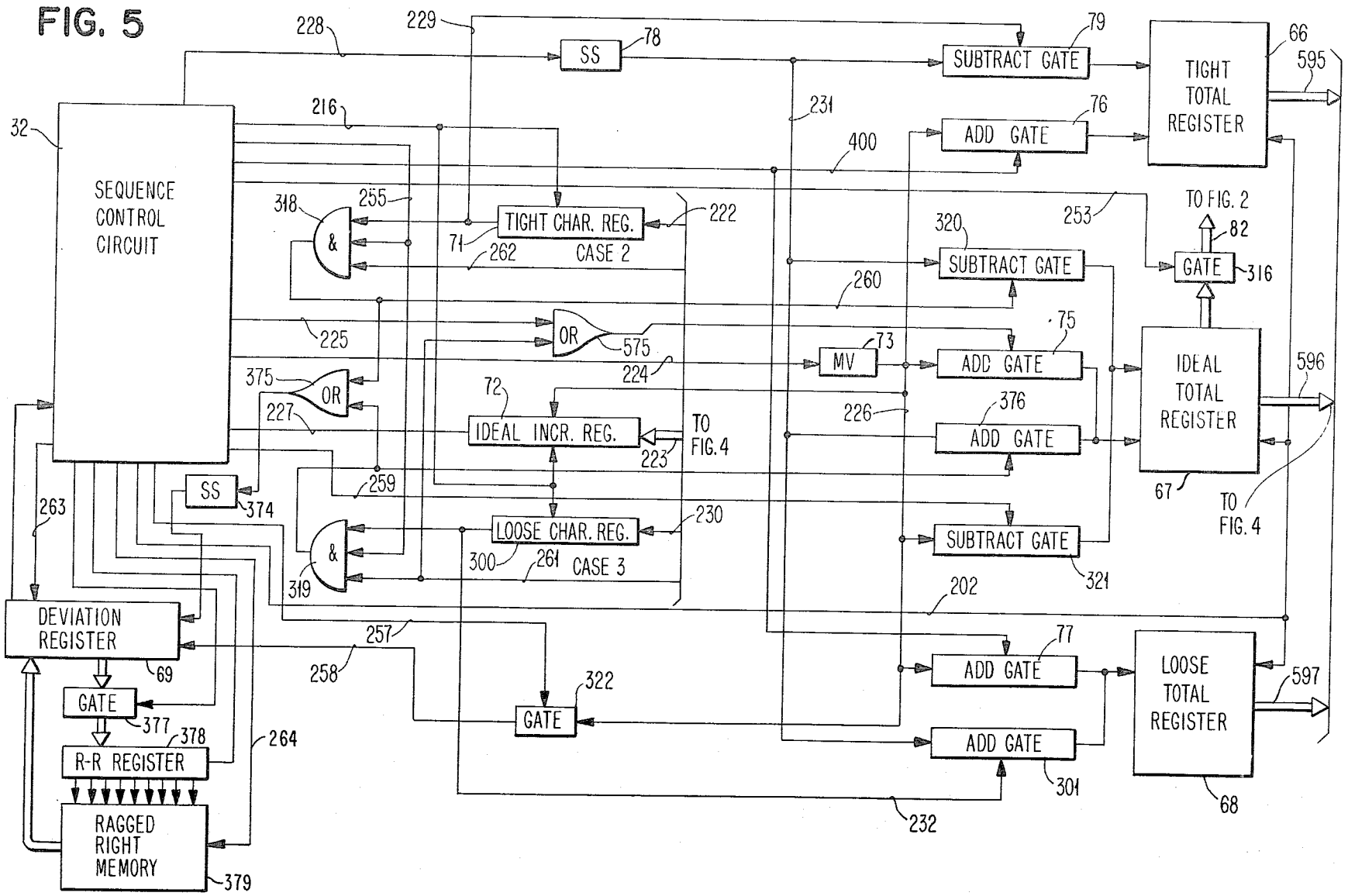
FIG. 5 is a circuit diagram for controlling the ragged right memory and for calculating the increments necessary for justification.

Referring now to FIG. 5, there is illustrated the means by which the tight, ideal, and loose line totals located in register 66, 67, and 68 respectively, are obtained from the intercharacter displacement and escapement variance memory 2 in FIG. 4. In addition, the apparatus in FIG. 5 calculates the difference in escapement between the margin and the ideal values and registers it in the deviation register 69.

Where line justified typing is undesirable prior to final playout, the operator may strike the ragged right button 3 on keyboard 18 and this will be stored in the sequence control circuit 32. As a result, the deviation register 69 will be modified by the sequence control circuit 32 in conjunction with gate 377, ragged right register 378, and ragged right memory 379.

OPERATION

Proportional Spacing

Referring now to FIGS. 1*a*, 2, and 2*a*, the operation of the machine as a proportional spacing printer will be described. Input characters keyed on the keyboard 18 are passed to the first character register 120 over data bus 21. In addition, keyboard 18 alerts the sequence control circuit 32 over lead 573 that the operator has keyed a character. Each time a character is keyed, it is placed in the first character register 120 and decoded by circuitry therein to determine if it is a printed character, a space, or a carrier return. If it is a space, the first character register 120 initiates a signal on lead 568 to sequence control circuit 32 and AND gate 133. If it is a carrier return, the first character register 120 initiates a signal on lead 555 to the sequence control circuit 32 and AND gate 133. Either of these two signals will inhibit the AND gate 133 from activating the print gate 132 over lead 580. If the entry into the first character register 120 is a printable character, then the output on both leads 555 and 568 remain at a logical zero and are inverted to logical ones at the input of AND gate 133. The sequence control circuit 32 then signals on lead 581 to AND gate 133, which in turn signals on line 580 to print gate 132 causing print gate 132 to connect bus 540 from the first character register 120 to bus 20 to the printing mechanism 10.

Following this, the sequence control circuit 32, over lead 569, gates the contents of the first character register 120, by way of gate 124, into the second character register 125 and resets the first character register 120. When the operator types the second character by means of keyboard 18, the content is stored in the first character register 120 by way of leads 21 as before. Again, lead 573 signals the sequence control circuit 32 that the second character has been keyed. The sequence control circuit 32 then initiates a signal on lead 563 to the intercharacter displacement memory 128. Memory 128 is addressed by means of the lead character selection matrix 127 and the trailing character selection matrix 126 being driven by the second character register 125 and the first character register 120, respectively. The resulting output from the intercharacter displacement memory 128 is an incremental count representing the displacement in increments of horizontal spacing between the first character keyed and the second character keyed. Each time another character is keyed by the operator the preceding character is shifted into the second character register 125 and the new character enters the first character register 120 and the memory 128 is interrogated to find the new displacement between these characters. In this manner the displacement between the two characters is not merely a function of the character width of each of the characters, but rather may differ between characters of the same width depending upon the shape of the characters.

After the intercharacter displacement memory 128 has read its value into the character displacement register 129, the sequence control circuit 32 starts multivibrator 130 by means of lead 564. Multivibrator 130 in turn causes pulses on lead 565. These pulse each subtract the count of one from character displacement register 129 until lead 566, back to the sequence control circuit 32 from the character displacement register 129, indicates no more increments remain within the character displacement register 129. Simultaneously, lead 565 was also incrementing the horizontal position register 131 with each of the pulses from multivibrator 130. The result is that the count originally placed in the character displacement register 129 by the intercharacter displacement memory 128 is transferred to the horizontal position register 131. Following this, the sequence control circuit 32 initiates a signal on line 552 to gate the absolute horizontal position of the printing mechanism 10 from the horizontal position register 131 by means of gate 121 to the horizontal data bus 82. Sequence control circuit 32 also initiates a signal on lead 553. Lead 553, in conjunction with the data bus 82 causes the horizontal positioning mechanism of the printer to position the print point 25 at the ideal distance from the point at which the first character was printed. On completion of the printing, the positioning circuitry sends a signal on lead 554 back to the sequence control circuit 32 and the signals on leads 552 and 553 are removed. The sequence control circuit 32 then sends a signal on lead 581 which causes the print gate 132 by means of AND gate 133 to gate the second character to be typed from the first character register 120 to the printing mechanism 10 over data buses 540 and 20. The printing mechanism 10 functions as previously described and prints the second character keyed. Following this, the sequence control circuit 32 resets the second character register 125 over lead 571, gates the contents of the first character register 120 into the second character register 125 through gate 124, and resets the first character register 120 over lead 570. At this point, the printer 12 is ready to accept the next keystroke from the keyboard 18.

The operator then proceeds to key the rest of the characters on the line in the same manner as described above, including Space characters which function identically with the print characters with respect to the intercharacter displacement memory 128. However, the space characters do not print since the space character causes a signal on lead 568 to AND gate 133 which inhibits the sequence control circuit 32 from selecting the print gate 132 through AND gate 133. Therefore, whenever a space character resides in the first character register 120, a horizontal positioning sequence will take place, but a print sequence will be blocked at the AND gate 133. On finishing the line the operator keys a carrier return at keyboard 18 which is encoded in the first character register 120 by means of leads 21 and initiates a signal on lead 573 to the sequence control circuit 32 indicating that a character has been keyed. The first character register 120 initiates a signal on lead 555 to the sequence control circuit 32 and to AND gate 133 which inhibits print gate 132. The sequence control circuit 32 then resets horizontal position register 132 through lead 567 advances the vertical position register 123 through lead 556. Following this the sequence control circuit 32 gates the contents of the horizontal position register 131 over lead 552 onto data bus 82 and starts the positioning sequence over lead 553. When the positioning sequence is completed, as previously described, the positioning circuitry located on FIG. 2 signals on lead 554 back to the sequence control circuit 32 indicating that the carrier return function has been performed. The sequence control circuit 32 then resets the first character register 120, and the second character register 125 in preparation for printing the next line. Each subsequent line is printed in the same manner as that described for the first line.

Justification: If the operator wishes to have the text keyed on the keyboard 18 right margin justified by the printer 12, the ragged right key 3 (FIG. 1*a*) must remain in the undepressed position. Referring now to FIGS. 3, 4 and 5, in order to type the first character, the operator will strike one of the character keys on keyboard 18, causing the keyboard signal generator 26 to encode that keystroke on leads 21. These signals are registered in byte register 29 and are decoded at logic block 28. If the character struck was an alphabetic character, lead 208 will provide a signal to sequence control circuit 32 indicating that the operator has typed the character. There will be no output on leads 204, 205, 206 or 207.

The sequence control circuit 32 then provides a signal on lead 209 gating the output of the byte register 29 through print gate 35 onto print control bus 20. This causes the printing mechanism 10 to position element 16 and print the corresponding character on the page 24 at a point designated by registers 83 and 93 as heretofore described. In addition, the sequence control circuit 32 provides a signal on line 508 to write the character residing in the byte register 29 into the page memory 31 by means of write gate 30 and increments the character position register 33 by one over lead 560. The sequence control circuit 32 next initiates a signal on lead 220 which activates gate 91 to transfer the character from the byte register 29 into the previous character register 39.

Escapement of the printing mechanism 10 to the next character print position 25 does not occur at this time, but is inhibited until the operator keys the next character. This is necessary since the space between the first character and second character will depend on the contour of the second character typed.

When the operator strikes the second character to be printed on the page 24, keyboard 18 codes byte register 29 through keyboard signal generator 26 over lines 21. Since the second character is also an alphabetic character, logic block 28 will output a signal to the sequence control circuit 32 over lead 208. With the byte register 29 and previous character register 39 providing address information through the decode circuits 37 and 38 respectively, the sequence control circuit 32 reads from the escapement variance memory 2 over lead 221. If the "couple", consisting of the first and second characters typed, is considered to be one which could be moved closer together than the ideal displacement, lead 222 will set the tight character register 71. In addition to this number of ideal increments of escapement between the two characters will be registered in the ideal incremental register 72 over lead 223. When this is completed the sequence control circuit 32 will activate multivibrator 73 over lead 224 and open gate 75 over lead 225. Each operation of the multivibrator 73 will cause a pulse on lead 226 which will decrement the ideal increment register 72 to its zero state. When this occurs the ideal incremental register 72 will provide a signal on lead 227 back to the sequence control circuit 32 which removes the signal from lead 224 and the multivibrator 73 stops pulsing.

In addition to pulsing the ideal incremental register 72, lead 226 adds the ideal count to the tight total register 66, ideal total register 67 and loose total register 68 through gates 76, 75, and 77 respectively means of lead 400 and lead 225 through OR gate 575. Following this, if the tight character register 71 has been set from the escapement variance memory 2, the sequence control circuit 32 initiates a signal on lead 228 to single shot 78 which causes one unit to be subtracted from the tight total register 66 by means of gate 79 which has been opened by lead 229 from the tight character register 71. The result of this is that the ideal escapement increment countdown between the first character typed and the second character typed has been recorded in the ideal total register 67 and in the loose total register 68. The tight total register 66, however, contains a count one less than the other two registers 67 and 68.

The sequence control circuit 32 next initiates a signal on lead 253 causing gate 316 to gate the total from the ideal total register 67 onto lead 82 to register 83 of the print point positioning circuitry found in FIG. 2 and initiates a signal on lead 553 causing the positioning sequence to occur. This causes the printing mechanism 10 to move the necessary number of increments to the right to allow ideal spacing between the first character keyed and already printed on the page 24 and the second character keyed which will be printed next.

The sequence control circuit 32 initiates a signal on lead 209 to print gate 35 setting the print command over lead 20 to the printing mechanism 10 and the second character is printed in the same manner as the first character. In addition, the sequence control circuit 32 operates gate 30 and records the character located in the byte register 29 by means of write lead 508 in its proper position in page memory 31 and again increments character position register 33 over lead 560. Following this, the sequence control circuit 32 gates the value of the second character typed from the byte register 29 into the previous character register 39 over lead 220, which completes the sequence by which the second character is printed.

This leaves the printing mechanism 10 in a position where it has printed the first character, then escaped and printed the second character. The operator then keys the next character and it is again recorded in the byte register 29. This information is forwarded to the sequence control circuit 32 again over lead 208 and the sequence control circuit 32 in turn provides a read signal to the escapement variance memory 2 over lead 221. This time, however, the "couple" between the second and third characters keyed typed is considered loose. That is, the distance can be increased by one increment without substantially affecting the aesthetic quality of the print. As a result, a loose character register 300 is set over lead 230 and again the ideal value of the escapement between the second and third characters is registered in the ideal incremental register 72 over lead 223.

Following this, the sequence control circuit 32 starts multivibrator 73 over lead 224 and reduces the count in the ideal incremental register 72 over lead 226. In addition, the pulses on lead 226 increase the total count in the tight total register 66, the ideal total register 67, and the loose total register 68 by the number of increments being registered in the ideal incremental register 72. When the ideal incremental register 72 has been reduced to zero, a signal on lead 227 is sent to the sequence control circuit 32. This causes the sequence control circuit 32 in turn to initiate a signal on lead 228 and cause single shot 78 to increase the count in the loose total register 67 by one through gate 301 which has been opened by lead 232 from the loose character register 300.

Following this, the printing mechanism 10 performs an escapement sequence, prints the third character, and upgrades the page memory 31 as has been previously described. The operator then continues keying each character of the first line in the same manner as has been described.

Each time the operator completes a word, the sequence control circuit 32, over lead 233, examines the results of the line analysis circuit 7 consisting of compare circuits 304, 305, and 306, and AND circuits 302 and 303. These compare circuits 305, 306 and 304 will compare the value of the total escapement in the tight, ideal, and loose total registers 66, 67 and 68 with the value in the printer right margin register 307 over lines 595, 596, 597 and 594. If the ideal total register 67 is equal to the right margin register 307, lead 235 will set the case 1 register 65 via lead 256 and gate 403, and send a signal back to the sequence control circuit 32 over leads 239 and 240 through OR gate 308. This time the sequence control circuit 32 gates a carrier return code by means of a circuit 309 and leads 270 and 590 into byte register 29 so that when the write command on lead 508 is issued by the sequence control circuit 32 the last character on that particular line in page memory 31 will be a carrier return. After storing the carrier return in page memory 31, sequence control circuit 32 increments the line position register 34 over lead 201 and resets the character position register 33 over lead 200. Following this, the sequence control circuit 32 initiates a positioning sequence over lead 553. The page 24 is indexed one line and the printing mechanism 10 is returned to the left margin 150 as a result of this action.

If during the line analysis caused by the signal on lead 233 from the sequence control circuit 32, the ideal total register 67 did not compare equal with the right margin register 307, as will generally be the case, the margin register 307 will either be larger or smaller than the ideal total register 67. If the right margin register 307 is smaller than the ideal total register 67 and the right margin register 307 is equal to or greater than the tight total register 66, the line analysis circuit 7 will initiate a signal on line 236 via AND circuit 303 and gate 401 and set the case 2 register 64. Case 2 represents the situation where the operator has over typed the right margin. However, the amount of overtyping can still be compensated for by reducing the intercharacter spacing between those particular characters which allow such a reduction without appreciably reducing the aesthetic quality of the printing. The loading of the case 2 register 64 sets a signal on lead 241 back to the sequence control circuit 32 which in turn terminates the line in exactly the same manner as described for case 1.

If during the line analysis, however, the total in the right margin register 307 exceeded the total in the ideal total register 67 and the total in the right margin register 307 was less than or equal to the total in the loose total register 68, the analysis circuit 7 will provide a signal on lead 237 via AND circuit 302 and gate 404. This signal will set the case 3 register 63. The case 3 register 63 in turn would set a signal on lead 242 back to the sequence control circuit 32 which would operate a bell 8 over lead 243 alerting the operator that the line can now be terminated. The sequence control circuit 32 now waits for a further indication from the operator as to whether an additional short word will be squeezed in on this line or the line terminated with the next word beginning on the next line.

If the operator strikes any key but a printing character, the sequence control circuit 32 will terminate the line in exactly the same manner as for case 1 or case 2. If the operator continues by typing a printable character this coded character will enter the byte register 29 and signal the sequence control circuit 32 over lead 208. The sequence control circuit 32 will then terminate the previous word by gating a space code from the circuit 310 by means of lead 238 into the page memory 31 and write this space into the page memory 31 by means of lead 508.

No escapement sequence will occur at the time this space is entered into page memory 31, but rather the sequence control circuit 32 will process the next character by means of the escapement variance memory 2 in the same manner as before described. However, when the total registers 66, 67 and 68 are updated, the increments provided by the escapement variance memory 2 between the preceding space and the first printed character in the word will contain the extra amounts of increment necessary to include the space. Since, in our system, positioning always occurs before printing, the additional spacing increments will be taken care of during positioning before the print sequence starts which will print the first character of this additional word on the line.

The operator then continues keying this word as heretofore described and the same analyzing sequence will take place at the end of the word. If, at the end of the word, it is determined that the right margin register 307 is less than the tight total register 66, indicating that the line cannot be justified with this additional word, the analysis circuit 7 will set a signal on lead 234 through gate 210 and an erase memory sequence will take place.

The erase memory sequence consists of backspacing and overstriking the last word printed and causing the printing mechanism 10 to carrier return to the next line where the word just overstruck is automatically reprinted. This sequence also includes updating the page memory 31 properly and is begun by the sequence control circuit 32 issuing a signal on lead 246 which decrements the character position register 33.

After the count in the character position register 33 is reduced by one, the sequence control circuit 32 causes a read operation from the page memory 31 to occur over lead 251 and the information read from the page memory 31, which at this point consists of the last character of the word to be removed, is placed in the byte register 29. Decode 28 then sets a signal on lead 208 indicating that the character is not a space. This causes the decrementing sequence (reducing the count in the character position register 33) to continue until the logic block 28 indicates that the character position register 33 is positioned to the space preceding the word which is to be removed from the line. The sequence control circuit 32 then replaces the space with a carrier return code in the byte register 29 by means of lead 270 and encode CR circuit 309 and writes the carrier return code into page memory 31 by means of write lead 508 and gate 30. The sequence control circuit 32 then increments the character position register 33 by one so that it is now pointing at the first character position of the word to be removed. The sequence control circuit 32 resets the old position register 313 over line 249 and signals to gate 314 over lead 244 to register this position in the old position register 313. The sequence control circuit 32 also initiates a signal on lead 245 resetting the new position register 311.

Next, the sequence control circuit 32 upgrades the page memory 31 by reading the first character of this word into the byte register 29 by means of lead 251 and gate 70, incrementing the line register 34 over lead 201, gating the value of the new position register 311 into the character register 33 via line 212 and gate 312, and writing the value of the byte register 29 into the page memory 31. This puts the first character of the last word of the preceding line into the first position in the next line in the page memory 31. Then the sequence control circuit 32 gates the value in the old position register 313 into the character position register 33 via gate 315 and lead 247, increments the character position register 33 by one over lead 560, and decrements the line position register 34 by one count over lead 252 which places the page memory 31 back on the preceding line at the second character of the word to be removed. Again, the value in the page memory 31 at this point is read by sequence control circuit 32 over lead 251 into the byte register 29, causing an output on lead 208 back to the sequence control circuit 32 from the decode logic block 28. The sequence control circuit 32 again gates the value of the character position register 33 into the old position register 313 and increments the new position register 311 over lead 248. The sequence control circuit 32 increments the line position register 34 and gates the new position register 311 into the character position register 33. At this point the content of the byte register 29 is gated back into the page memory 31 via lead 508 and as a result the second character of the word to be eliminated from the previous line has been placed in page memory 31 as the second character of the new line. This sequence will continue in the same manner until the bytes being read from the page memory 31 by the old position register 313 is decoded by logic block 28 as a space over lead 204. When this occurs, the system places a space terminating the word being transferred into page memory 31 in the same manner as the characters described heretofore and determines that the entire word is now been relocated in page memory 31 as the first word in the new line. The sequence control circuit 32 then starts the printer repositioning sequence by first resetting the character position register 33. Next, the entire line is read one character at a time from the page memory 31 and inserted into the byte register 29. Each time the byte register 29 is filled the total in sequence is repeated and as a result the ideal total register 67 contains the total count within the line when the logic block decode circuit 28 finds the carrier return code which was placed in the page memory 31 during the erase memory sequence. At this point, the sequence control circuit 32 increments the character position register 33 once more and reads the first character of the word that has just been repositioned from the page memory 31 into byte register 29, upgrades the ideal total register 67 and causes the value in the ideal total register 67 to be gated via gate 316 to signal lead 82 through control lead 253. The sequence control circuit 32 initiates a signal on lead 553 starting a repositioning sequence which brings the print element 16 over the first character of the word to be eliminated in this line. When repositioning is completed, a stop signal is produced on lead 554 from AND gate 105 to sequence control circuit 32 and the sequence control circuit 32 gates a print slash command via circuit 317 and lead 250 onto bus 20 causing the printing mechanism 10 overstrike a slash on the first character to be eliminated from the line.

The sequence control circuit 32 then increments the count in the character position register 33 and the slash is printed over each of the remaining characters in the word to be eliminated. When the decode 28 again decodes a space in the byte register 29, it signals the sequence control circuit 32 on lead 204 which causes the line position register 34 to increment by one and which resets the character position register 33. Again, the sequence control circuit 32 requests a positioning sequence and the printing mechanism 10 is moved to the first position of the next printing line automatically. Following this the sequence control circuit 32 reads the first character from the next line and performs the print routine via print gate 35 which results in printing the first character of the overstruck word at the beginning of the next line. The second character is then read from page memory 31 and, utilizing the escapement variance memory 2 and the positioning circuitry (FIG. 2), the intercharacter escapement is performed by the printing mechanism 10 followed by the printing of the second character. In this way all of the characters of the word eliminated from the previous line are introduced as the first word of the new line and operator continues keying on the new line exactly in the same manner as described for the previous line.

Any time during the printing of the line when the operator keys a space and the line analysis circuit 7 finds that the right margin register 307 is less than the loose total register 68, the space, which is already located in the byte register 29, is gated into the page memory 31 via lead 214 and written there by a signal on line 508. No escapement occurs at this space but rather escapement will occur after the operator has keyed the next character and prior to the printing of that character.

The operator then proceeds to key all of the remaining lines in the same fashion. On completion, the document has been printed with the ideal intercharacter spacing but has a ragged right margin and might have overstrikes in line ending positions due to overkeying of a line. The page memory 31, however, now contains data which, when played out, can produce a document with no further operator decision that contains a justified right margin and still maintains excellent printing appearance.

After completing the keying of the page of text, the operator adds a clean sheet of paper and depresses the auto/playout button 19 on the keyboard 18 to produce a final copy. This is encoded by the keyboard signal generator 26 and placed in byte register 29. Decode logic block 28 indicates on lead 206 to sequence control circuit 32 that the auto/playout button 19 has been depressed. The sequence control circuit 32 then resets the character position register 33 on line 200, the line position register 34 on line 215, the ideal increment register 72 on line 216, the tight and loose registers 71 and 300 on line 216 and all of the total registers 66, 67 and 68 on line 202. Following this, the read command is issued on control lead 251 to the page memory 31 and the first byte in page memory 31 is placed in the byte register 29 via gate 70 and signal lead 254. The content of the byte register 29 in turn is gated into the previous character register 39 following which the sequence control circuit 32 increments the character position register 33 to the second character in the line. Again the sequence control circuit 32 reads the second character from page memory 31 into the byte register 29. Next the sequence control circuit 32 reads from the escapement variance memory 2 and records the ideal increment value in the ideal increment register 72 as heretofore described. In addition, the tight tool register 66, the ideal total register 67, and the loose total register 68 are increased to a value determined by the tight character register 71, the ideal increment register 72 and the loose character register 300. This sequence of upgrading the total registers 66, 67 and 68 will continue until the character read from page memory 31 into the byte register 29 is decoded by logic block 28 to be a carrier return. When this occurs, case 1 register 65, case 2 register 64 or case 3 register 63 will be set as a result of the comparison of the totals on line 595, 596 and 597 with the total on line 594 by the line analysis circuit 7 consisting of comparators 304, 305 and 306 and logic circuits 302 and 303.

The number of increments to be added or subtracted from the ideal value of displacement for each character pair in the line just totaled must now be determined. To do this, the sequence control circuit 32 signals on lead 224 to multivibrator 73 and pulses on lead 226 are gated to the ideal total register 67 through either add gate 75 if the line of print being processed has been determined to be a case 3 or a substract gate 321 if the line has been determined to be case 2 line. For a case 3 line, multivibrator 73 will add increments to ideal total register 67 until comparator 306 indicates that the ideal total register 67 is equal to the printer right margin register 307 by signalling on lead 256. When this occurs sequence control circuit 32 releases lead 224 stopping multivibrator 73.

During the time when the multivibrator 73 is pulsing, the sequence control circuit 32 also signals lead 257 to gate 322 which allows multivibrator pulses to increment the deviation register 69 over lead 258, thus the deviation register 69 provides a count of the number of increments which must be added to a given line in a case 3 line to expand that line from the ideal total to the number required to equal the right margin register total.

During line analysis, if the line was determined to be a case 2, at the time multivibrator 73 is pulsing, subtract gate 321 will reduce the ideal total register 67 rather than increase the total as in case 3. Again, when the ideal total register 67 equals the right margin register 307, the compare circuit 306 will provide a signal on lead 256 back to the sequence control circuit 32 stopping multivibrator 73, but as described before, gate 322 will record these multivibrator pulses in the deviation register 69 so that the deviation register 69 will contain the number of increments which must be subtracted from the line in order to have to the total number of increments in the line equal to the total registered in the right margin register 307.

After the deviation register 69 has been set the sequence control circuit 32 again resets the total registers 66, 67 and 68, the tight and loose character registers 71 and 300, and the ideal increment register 72 as well as the character position register 33. The page memory 31 again provides, by means of gate 70 and read line 251, the value of the character in the first position of line to byte register 29. If it was determined by analysis circuit 7 that the first line to be played back was a case 2 line, the case 2 register 64 would still be set at this time. The sequence control circuit 32 next causes the print gate 35 to print the character stored in the byte register 29 and gate the first character via line 373 into the previous character register 39. Next the sequence control circuit 32 increments the character position register 33 and the page memory 31 presents the second character into the byte register 29. The sequence control circuit 32 then reads from the escapement variance memory 2 into the tight character register 71, loose character register 300, and the ideal increment register 72. After this multivibrator 73 is again started over lead 224 and the value registered in the ideal increment register 72 is entered into the ideal total register 67. The sequence control circuit 32 signals on lead 255 to AND circuits 318 and 319 and signals on lead 228 to single shot 78. Single shot 78 pulses lead 231 causing subtract gate 320 to decrement the ideal total register 67 by one. The subtract gate 320 had previously been closed by lead 260 which was set through AND circuit 318 for any case 2 line when the tight character register 71 is set by the escapement variance memory 2. The AND circuit 318 is set by a signal on line 262 from the case 2 register 64. Simultaneously AND circuit 318 also fires single shot 374 through OR gate 375. This single shot 374 decrements the deviation register 69 by one increment.

The sequence control circuit 32 then signals on lead 253 to gate 316 which gates the value in the ideal total register 67 onto lead 82 back to register 83. Next the sequence control circuit 32 causes a positioning sequence by initiating a signal on lead 553. This causes the print element 16 to be moved to the next character position on the line, however, the spacing between the first two characters is one increment less than ideal in order to compact the line enough so that the right hand margin on all lines will be identical. If the tight character register 71 had not been set by the escapement variance memory 2, an ideal spacing would occur between the first and second characters. Single shot 78 will only be used to reduce the ideal total register 67 until such time as the deviation register 69 is empty. After which time all characters in the line will be spaced apart by the ideal value.

If the line had been a case 3 line, during the sequence in which the deviation register 69 is set, lead 261 would signal add gate 75 through circuit 575 and instead of subtracting from the ideal total register 67 the multivibrator 73 would add increments to ideal total register 67 until such time as it equals the right margin register 307. During the printout of a case 3 line, when loose character register 300 is set, single shot 78 increments the ideal total register 67 by means of add gate 376, causing the two adjacent characters to be one unit farther apart that the ideal space rather than one unit closer together as for the case 2 line. Also, when loose character register 300 is set, AND gate 319, which is set by a signal on line 261 from case 3 register 63, will gate add gate 376 and also single shot 374 through OR gate 375. Single shot 374 will also subtract one unit from deviation register 69 until the deviation register 69 has been reduced to zero. This causes all loose "couples" in a case 3 line to be expanded by one increment until the deviation register 69 has been reduced to zero. The result will be that the line will be expanded to the value registered in the right margin register 307.

During the previous description, the resulting product was a page 24 with all lines justified. For some types of business operations justified copy is considered an extravagance or possibly less personal than type written copies with a ragged right margin. In order to allow this ragged right margin, but decrease its deviation to a significant extent, while removing the necessity for operator intervention, the preceding sequences are used with the addition of the following procedure. First, prior to depressing the auto/playout key 19, the operator depresses the ragged right key 3. This code is placed in byte register 29 and decoded by logic block decode 28 over lead 207 which sets a ragged right mode register 32*a* in the sequence control circuit 32 for later use. Then after the deviation register 69 has been set, as described during the difference determination sequence, the sequence control circuit 32 signals on lead 263 which gates the value then located in deviation register 69 by means of gate 377 into ragged right register 378. The ragged right register 378 in turn selects a position in ragged right memory 379. Next the sequence control circuit 32 initiates a signal on lead 264 which reads out of the ragged right memory 379 and places this value back into the deviation register 69. This new value in the deviation register 69 will cause the right margin of the page 24 being printed to vary by less than one-half inch in all cases. The result is a varying typewritten copy with a right margin varying by a maximum one-half inch.

While the invention has been particularly shown and described with reference to a preferred embodiment thereof, it would be understood by those skilled in the art that the foregoing and other changes in form and detail may be made therein without departing from the spirit and scope of the invention. For example, the apparatus of this invention could be used to proportionally space and justify text input from magnetic media or communicated to the system as well as text input from a keyboard as described herein. Furthermore, it is obvious that variable interword spacing may be combined with the described intercharacter spacing without departing from the scope of this invention.

What is claimed is:

1. Apparatus for printing justified text comprising:

memory means containing predefined ideal escapement values and escapement variance values for intercharacter spacing based on the contours of the characters and the aesthetic appearance of character combinations, a character source, means for accumulating a plurality of characters and spaces from said character source to form a printing line, means for accumulating an ideal escapement value total and escapement variance value totals from said memory means for said accumulated characters and spaces of said printing line, means for defining the total escapement value in the printing line, means for comparing said accumulated ideal escapement value total and said escapement variance value totals with said total escapement value for the printing line, means for terminating said printing line when said accumulated ideal escapement value total and one of said escapement variance value totals bracket said defined total escapement value, means for determining a deviation escapement value based on said accumulated ideal escapement value total, said defined total escapement value, and said one of said escapement variance value totals; and a variable spacing printing mechanism responsive to said deviation escapement value to modify the intercharacter escapement of the accumulated characters in accordance with predetermined intercharacter escapement variance values based on the aesthetic appearance of character combinations so that the actual escapement value of said printing line equals the defined total escapement value of said printing line.

2. The apparatus for printing justified text of claim 1 wherein said escapement variance value totals include a loose escapement total value for spacing certain combinations of characters farther apart than their ideal spacing in order to lengthen the printing line to equal the defined total escapement value and a tight escapement value total for spacing certain character combinations closer together in order to shorten the printing line to equal the defined total escapement value.

3. The apparatus for printing justified text in claim 1 wherein said means for defining the total escapement value in the printing line is a register storing a value set by the right margin of the printer.

4. The apparatus for printing justified text of claim 1 wherein said source of characters is a keyboard.

5. The apparatus for printing justified text of claim 2 wherein said means for terminating said printing line includes means for deleting the last word from a printing line where said tight escapement value total exceeds the defined total escapement value and means for placing the deleted word at the beginning of the next line.

6. Apparatus for printing text with a limited variable right margin comprising:

memory means containing predefined ideal escapement values and escapement variance values for intercharacter spacing based on the contours of the characters and the aesthetic appearance of character combinations, a character source, means for accumulating a plurality of characters and spaces from said character source representing a line of text, means for accumulating an ideal escapement value total and escapement variance value totals from said memory means for said accumulated characters and spaces of said line of text, means for defining the total escapement value in a printing line, means for comparing said accumulated ideal escapement value total and escapement variance value totals with said total escapement value for the printing line, means for terminating said line of text when said accumulated ideal escapement value total and one of said escapement variance value totals bracket said defined total escapement value, means for determining a deviation escapement value based on said accumulated ideal escapement value total, said defined total escapement value, and said one of said escapement variance value totals, storage means containing a maximum variant escapement value for the right margin of said line of text, means for substituting said maximum variant escapement value for said deviation escapement value, and a variable spacing printing mechanism responsive to said maximum variant escapement value to modify the intercharacter escapement of the accumulated characters in accordance with predetermined intercharacter escapement variance values based on the aesthetic appearance of character combinations so that the right margin of the printed text ends within a range determined by the maximum variant escapement value.

7. Apparatus for printing text with a limited variable right margin comprising:

memory means containing predefined ideal escapement values and escapement variance values for intercharacter spacing based on the contours of the characters and the aesthetic appearance of character combinations;

a character source;

mode selection means for defining a variable right margin mode;

storage means containing a range of values for the right margin of a line of text;

means for defining the total escapement value in a printing line;

means for accumulating a plurality of characters and spaces from said character source representing a line of text;

means for accumulating escapement value totals from said memory means for said line of text;

means for comparing said accumulated escapement value totals for said line of text to said total escapement value for said printing line;

means for selecting a right margin value from said storage means for said line of text when said accumulated escapement value totals approximate said total escapement value for said printing line; and a variable spacing printing mechanism, responsive to said means for selecting, to print said line of text in accordance with the selected right margin value.

8. A method for producing right margin justified printing comprising the steps of:

defining ideal escapement values and escapement variance values for intercharacter spacing as a function of the contours of the characters and the aesthetic appearance of combinations of characters;

receiving a stream of characters and spaces to form a printing line;

accumulating an ideal escapement value total and escapement variance value totals for pairs of characters in said stream based on the defined escapement values;

defining a total escapement value for the printing line;

comparing the accumulated ideal escapement value total and the escapement variance value totals with said total escapement value;

terminating said printing line when said ideal escapement value total and one of said escapement variance value totals bracket said total escapement value; and adjusting the intercharacter escapement of combinations of said characters in accordance with the defined escapement variance values until the actual escapement value equals the defined total escapement value of said printing line.

9. A method for producing right margin justified printing comprising the steps of:

defining ideal escapement values and escapement variance values for intercharacter spacing as a function of the contours of the characters and the aesthetic appearance of character combinations;

defining an order of preferred selectivity for character pairs based on the relative aesthetic value of varying the intercharacter spacing of said character pairs;

receiving a stream of characters and spaces to form a printing line;

accumulating an ideal escapement value total and escapement variance value totals for pairs of characters in said stream based on the defined escapement values and the defined order of preferred selectivity;

defining a total escapement value for the printing line;

comparing the accumulated ideal escapement value total and the escapement variance value totals with said total escapement value;

terminating said printing line when said ideal escapement value total and one of said escapement variance value totals bracket said total escapement value; and adjusting the intercharacter escapement of said stream of characters in accordance with the defined escapement variance values based on the order of preferred selectively until the actual escapement value equals the defined total escapement value of said printing line.

10. A method for producing printed text with a limited variable right margin comprising the steps of:

defining ideal escapement values and deviation escapement values for intercharacter spacing as a function of the contours of the characters and the aesthetic appearance of combinations of characters;

receiving a stream of characters and spaces to form a line of text;

accumulating escapement value totals for pairs of characters in said character stream based on the defined escapement values;

defining a total escapement value for the printing line;

defining a maximum variant value for the right margin of said printing line;

comparing the accumulated escapement value totals with the defined total escapement value for said line of text;

terminating said line of text when said accumulated escapement value totals approximate said total escapement value for the printing line; and adjusting the intercharacter escapements of combinations of said characters in accordance with the defined deviation escapement values such that the difference between said defined total escapement value and the accumulated total escapement value for the printing line is less than the maximum variant value.

* * * * *